United States Patent [19]

Shannon

[11] Patent Number: 4,505,534

[45] Date of Patent: Mar. 19, 1985

[54] CABLE CONNECTOR AND METHOD

[76] Inventor: John K. Shannon, 200 S. Vincennes Cir., Racine, Wis. 53402

[21] Appl. No.: 432,650

[22] Filed: Oct. 4, 1982

[51] Int. Cl.[3] ..... H01R 4/30

[52] U.S. Cl. ..... 339/263 R; 339/276 SF; 339/270 R

[58] Field of Search ..... 339/263, 272, 199, 276 SF, 339/270 R

[56] References Cited

U.S. PATENT DOCUMENTS

| | | | |
|---|---|---|---|
| 1,535,694 | 4/1925 | Smith | 339/272 B |
| 2,920,305 | 1/1960 | Gibson et al. | 339/272 R |
| 3,125,397 | 3/1964 | McGrath | 339/272 R |
| 3,829,825 | 8/1974 | Hawkins | 339/272 UC |
| 3,857,349 | 12/1974 | Pritulsky | 339/263 R |

FOREIGN PATENT DOCUMENTS

| | | | |
|---|---|---|---|
| 419275 | 2/1967 | Switzerland | 339/272 UC |
| 781003 | 8/1957 | United Kingdom | 339/272 UC |

*Primary Examiner*—Joseph H. McGlynn
*Assistant Examiner*—David L. Pirlot
*Attorney, Agent, or Firm*—Jack E. Dominik

[57] ABSTRACT

Disclosed is a cable connector in which a body portion has an anchor and anchor connector. A cable clamp of flat material with threaded edges at one end is provided with an interior cable grip in the form of a hole. A cable clamp slot is provided in the body of the connector to receive the flat cable clamp. After the strand end of the cable is inserted into the cable grip hole, a cable clamp nut threadedly engages the nut threads of the cable clamp and moves the clamp into a tight gripping relationship with the cable. In assembling, the cable clamp is force-fitted into the cable clamp slot. To assure alignment, and deburring so that the strand end of the cable will enter the connector easily, a tool is employed to align the cable clamp hole with the cable tube portion of the body, while at the same time deburring the table clamp.

4 Claims, 5 Drawing Figures

CABLE CONNECTOR AND METHOD

FIELD OF THE INVENTION

The present invention is directed to a cable connector and method, of the type which finds principal utility in connection with battery cables and securing the same to a terminal connector. The subject structure, however, can also be used in other applications where cable is to be secured into an anchor. Normally good electrical characteristics are desired.

SUMMARY OF THE PRIOR ART

Cable connectors illustrative of the present invention are shown in applicant's U.S. Pat. Nos. 3,588,790 and 3,695,336. As noted in both of those patents, the connector has a body portion and a threaded member having a hollow interior. The hollow interior or hole receives the strand end portion of the cable, and then a connector nut engages the threaded end of the clamp, and clampingly and deformingly engages the strand end of the cable. Such connectors require a screw machine part with 360° of thread. They also interconnect a large portion of the cable and oftentimes the clamping area is approximately the diameter of the strand. The longer the clamping portion, the less the deformation, and the increasing likelihood of dislodgement if the cable clamp is not securely engaged.

SUMMARY OF THE INVENTION

The present invention is directed to a cable connector in which a body portion has an anchor and anchor connector. A cable clamp of flat material with threaded edges at one end is provided with an interior cable grip in the form of a hole. A cable clamp slot is provided in the body of the connector to receive the flat cable clamp. After the strand end of the cable is inserted into the cable grip hole, a cable clamp nut threadedly engages the nut threads of the cable clamp and moves the clamp into a tight gripping relationship with the cable. In assembling, the cable clamp is force-fitted into the cable clamp slot. To assure alignment, and deburring so that the strand end of the cable will enter the connector easily, a tool is employed to align the cable clamp hole with the cable tube portion of the body, while at the same time deburring the cable clamp.

In view of the foregoing it is a principal object of the present invention to provide a terminal cable connector which achieves a tight crimp in the strand portion of the cable with a clamping member which will not twist when the clamping nut is tightened.

A related object of the invention is to provide a terminal cable connector which does not utilize screw machine parts but rather an inexpensively formed stamping.

Yet another object of the present invention is to produce a terminal cable connector in which a smooth ingress is provided for the stranded end of the cable.

BRIEF DESCRIPTION OF THE DRAWINGS

Further objects and advantages of the present invention will become apparent as the following description of an illustrative embodiment takes place, in conjunction with the drawings, in which.

DESCRIPTION OF A PREFERRED EMBODIMENT

Figure 1:
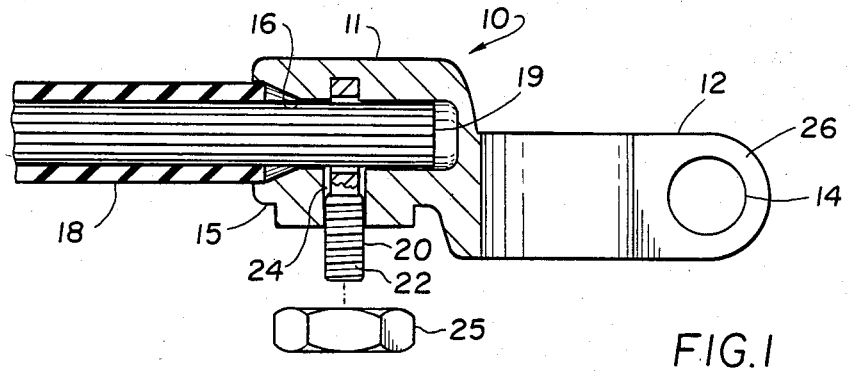
FIG. 1 is a longitudinal sectional view of an illustrative terminal cable connector showing the clamp nut in exploded relationship to the clamp.

As shown in FIG. 1, the illustrative connector 10 has a body portion 11 with an anchor portion 12, in this instance shown as opposed jaws. The anchor connector 14 includes opposed bore holes in the anchor jaws, suitable to receive an anchor nut.

A cable housing 15 is provided at a remote portion from the anchor 12, and interiorly of the cable housing 15 is a cable tube portion 16. As noted particularly in FIG. 1, the cable 18 has a stripped cable strand end 19. The cable strand end 19 is inserted into the cable tube 16.

After the cable strand end 19 is inserted into the cable tube 16 the already in place cable clamp 20 and more particularly its cable grip hole 21 engage the cable strand end 19 by means of the nut threads 22. The cable clamp is positioned in a cable clamp slot 24 in the body 11 of the connector 10. Thereafter the cable clamp nut 25 engages the cable clamp nut threads 22. Subsequently the jaws 26 of the terminal are also clamped and typically a battery terminal post is engaged.

Figure 2:
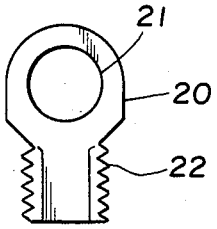
FIG. 2 is a plan view of the cable clamp.
Figure 4:
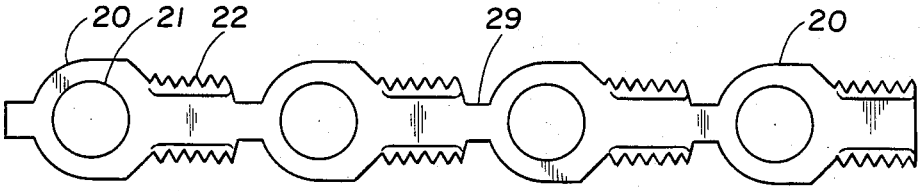
FIG. 4 is a view of the clamp blank which is formed by a die stamping.
Figure 5:
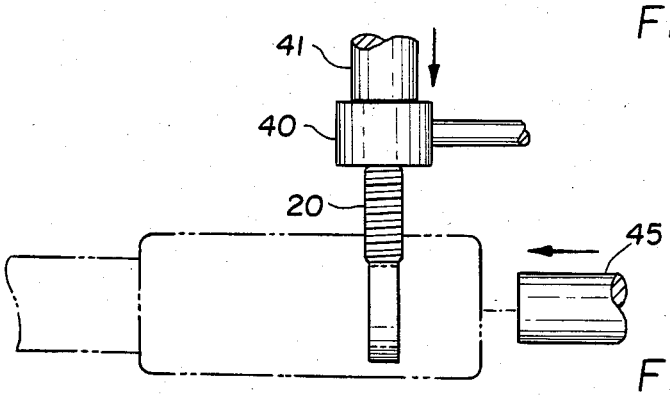
FIG. 5 is a diagrammatic view showing the method for inserting the clamp into the terminal connector and aligning the clamp and deburring the same.

As noted in detail in FIGS. 2 and 4, the cable clamp 20 is a stamping, and at its one end portion nut threads 22 are stamped on an extension of the body of the cable clamp. The threads 22 may also be roll formed, swedged, or otherwise formed. A cable grip hole 21 is formed in the center. As noted particularly in FIG. 4, the assembly of cable clamps 2 are joined by leads 29 which are stamped free to form the individual cable clamps 20 of the configuration shown in FIG. 2.

Figure 3:
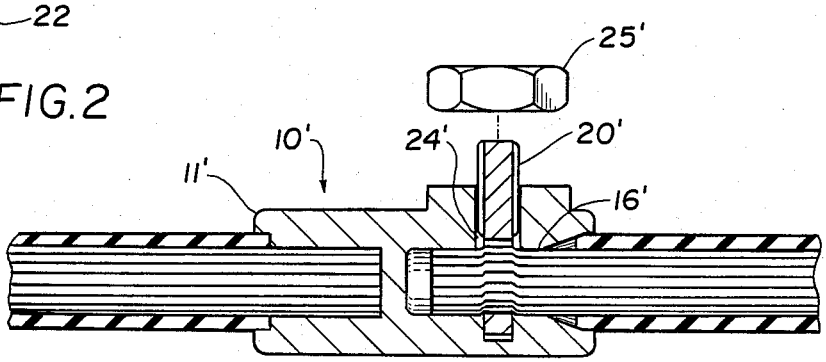
FIG. 3 is a longitudinal sectional view in the same scale as FIG. 1 showing an alternative embodiment of the terminal cable connector.

An alternative embodiment connector 10' is shown in FIG. 3. It will be seen that the body portion 11' has a cable clamp slot 24', and a cable tube 16'. The cable clamp 20' is engaged by means of the cable clamp nut 25' in much the same fashion as shown in the first embodiment connector 10 in FIG. 1.

In the method of assembly, the cable clamp 20 is engaged by a mandrel 40 and mandrel hammer 41 to position the same securely within the cable clamp slot 24. Thereafter the alignment and deburring tool 45 is pressed into the cable tube 16 to debur any rough edges, and assure alignment of the cable clamp 20. Dimensionally, the cable clamp 20 in both embodiments is designed for a force-fit in the cable clamp slot. Since the terminals 10, 10' are normally formed of lead or other soft metal, this permits the force-fitting of the cable clamp 20, 20'.

Although particular embodiments of the invention has been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and appended claims.

What is claimed is:

1. A cable connector comprising, in combination, a body, said body having an anchor portion, said body having a cable tube interior portion, a clamp slot in open communication from the exterior of the body to the cable tube portion, a cable clamp of flat configuration with threads at its end portion and having a central cable grip hole, said cable clamp being a stamped part, with threads extending from one end therefrom and stamped thereon, said cable clamp being aligned in the cable slot, and threaded means for engaging the threaded end of the clamp to misalign the same with the cable tube thereby engaging the strand end of a cable.

2. In the terminal cable connector of claim 1, said anchor means comprising a jaw member.

3. In the terminal cable connector of claim 1, said terminal having an additional cable secured interiorly thereof at an end remote from the cable tube.

4. In the terminal connector of claim 1, said cable tube interior portion having one end open for receiving the end of a cable, and a dead end at the opposite portion to limit the access of the cable end portion interiorly of the tube.

* * * * *